US005219451A

United States Patent [19]

Datta et al.

[11] Patent Number: 5,219,451

[45] Date of Patent: Jun. 15, 1993

[54] OFFSHORE DECK TO SUBSTRUCTURE MATING SYSTEM AND METHOD

[75] Inventors: Bisuddha N. Datta, Katy; Russell L. Baldwin, Houston; Junius D. Allen, Dallas, all of Tex.

[73] Assignee: Atlantic Richfield Company, Los Angeles, Calif.

[21] Appl. No.: 874,235

[22] Filed: Apr. 24, 1992

[51] Int. Cl.[5] ..... E02D 25/00

[52] U.S. Cl. ..... 405/204; 405/203; 405/209

[58] Field of Search ..... 405/204, 203, 209, 195, 405/196, 205, 229

[56] References Cited

U.S. PATENT DOCUMENTS

| | | | |
|---|---|---|---|
| 4,242,011 | 12/1980 | Karsan et al. | 405/204 |
| 4,436,454 | 3/1984 | Ninet et al. | 405/204 |
| 4,607,982 | 8/1986 | Brasted et al. | 405/204 |
| 4,655,641 | 4/1987 | Weyley | 405/204 |
| 4,662,788 | 5/1987 | Kypke et al. | 405/204 |
| 4,729,695 | 3/1988 | Silvestri | 405/204 |
| 4,761,097 | 8/1988 | Turner | 405/204 |
| 4,848,967 | 7/1989 | Weyler | 405/204 |
| 4,930,938 | 6/1990 | Rawstron et al. | 405/204 |

*Primary Examiner*—Dennis L. Taylor
*Attorney, Agent, or Firm*—Michael E. Martin

[57] ABSTRACT

An offshore deck or platform unit is provided with depending legs having shock absorbing stabbing tip assemblies for engagement with the upstanding columns of a marine substructure to transfer the weight of the deck to the substructure by positioning the deck relative to the substructure with a barge and ballasting down the barge to move the deck into engagement with the substructure. The barge also carries a deck support structure comprising plural sand jack assemblies which provide for disengagement of the barge from the deck. The stabbing tip assemblies include coaxially arranged primary locating pins which are dropped into position to hold the location of the deck relative to the columns and annular resilient collars for transferring vertical and lateral shock loads between the columns and the deck during the transfer process. Final steel-to-steel engagement of the deck legs with the columns and final disconnection of the vessel from the deck is carried out by actuation of sand jacks which are interposed between the stabbing tip assemblies and the columns and between the deck and deck support structure on the barge.

15 Claims, 7 Drawing Sheets

OFFSHORE DECK TO SUBSTRUCTURE MATING SYSTEM AND METHOD

BACKGROUND OF THE INVENTION

1. Field of the Invention

The present invention pertains to a system and method for transferring an integrated offshore platform deck from a vessel to support piles or other substructure.

2. Background

Various methods have been considered for installing offshore platforms on support piles or other support structure. In certain situations, large shipmounted cranes are preferable for transferring an integrated deck from its support vessel to the substructure. In other situations, it is preferred to utilize a ballastable barge or other vessel which supports the platform deck, moves the deck into position over the substructure and then is ballasted down to lower the deck onto the substructure. Aligning the deck with the support piles of the substructure and transferring the weight of the deck to the substructure is a difficult procedure, particularly when motion of the sea is taken into consideration.

Several methods and systems are described in the prior art, such as U.S. Pat. No. 4,436,454 to Ninet, et al, issued Mar. 13, 1984, which describes a stabbing tip assembly with a centering pin extending below the lower end of the deck leg, and a compressible damping unit interposed between the centering pin and an upper section of the centering mechanism. U.S. Pat. No. 4,607,982, issued to Brasted, et al on Aug. 26, 1986, describes a platform deck to substructure mating system and method wherein a separate locating pin between the deck and the substructure guides the deck leg into position for being supported by a resilient neoprene pad interposed between the deck leg and a sand jack. U.S. Pat. No. 4,729,695 to Sylvestri, issued Mar. 8, 1988, describes a deck to platform transfer system wherein hydraulic lift cylinders are used to raise and then lower the deck legs onto the jacket legs. U.S. Pat. No. 4,761,097 to Turner, issued Aug. 2, 1988, describes a system for absorbing the shock loading between the deck legs and the substructure piles wherein a sand bin is provided on the pile to receive the tip of the deck leg to minimize dynamic forces that occur during the mating procedure. U.S. Pat. No. 4,848,967 to Weiler, issued Jul. 18, 1989, describes a deck to substructure transfer system wherein each of the deck legs includes a hydropneumatic cylinder and piston type actuator for stabbing into receptacles on the substructure piles which cylinders work in conjunction with stacked elastomeric disks which are compressed between the cylinders and the deck. U.S. Pat. Nos. 4,242,011 to Karsan, et al, issued Dec. 30, 1980; 4,252,468 and 4,252,469 both issued to Blight on Feb. 24, 1981, describe a method and system for transferring a deck from a barge to a substructure wherein locating pins which align the deck to the substructure are fitted with lateral and vertical force damping hydraulic cylinders. U.S. Pat. No. 4,930,938 to Rawstron, et al describes a deck to substructure mating assembly adapted to accommodate misalignment and fitted with primary and secondary load transfer devices.

Several aspects of the present invention are provided to improve the construction and operation of means for performing the alignment or locating function, the vertical and lateral shock force absorbing function and the final load transfer of the deck to the substructure pile which will enable more efficient and less hazardous, with respect to potential damage to the structures, transfer of an integrated deck or platform to a substructure located offshore.

SUMMARY OF THE INVENTION

The present invention pertains to an improved system for transferring an integrated deck to an offshore substructure characterized by a plurality of upstanding piles or legs which are mated with a corresponding number of depending legs connected to the deck or platform and wherein the transfer process may be carried out by a ballastable vessel which transports the deck to the placement position.

In accordance with one important aspect of the present invention, a unique stabbing tip assembly is provided for the depending legs of a deck or platform for initially locating the deck legs with respect to associated support piles of a substructure, for absorbing vertical and lateral shock loads, and for carrying out final transfer of the weight of the deck to the support piles.

In accordance with another important aspect of the present invention, an improved support arrangement between a deck and support vessel is provided which includes deck to support shock absorbing means and simplifies the process of disconnecting the vessel from the deck structure after the weight of the deck has been transferred to the substructure.

In accordance with yet a further aspect of the present invention, a load transfer and positioning mechanism is provided for the support legs of an offshore platform structure for transferring the weight of the structure to support piles and final mating of the legs to the support piles. Stabbing tip assemblies are provided on each of the deck legs which include elastomeric shock absorbing members and sand jacks which simplify the transfer of weight of the deck to the substructure and the final positioning of the deck legs contiguous with the support piles of the substructure.

In accordance with still a further aspect of the invention an improved method for transferring a platform to an offshore substructure is provided which includes staged transfer of the weight of the deck or platform to the substructure.

The above-mentioned superior features and advantages of the present invention, together with other important aspects thereof will be further appreciated by those skilled in the art upon reading the detailed description which follows in conjunction with the drawing.

DESCRIPTION OF PREFERRED EMBODIMENTS

Figure 1:
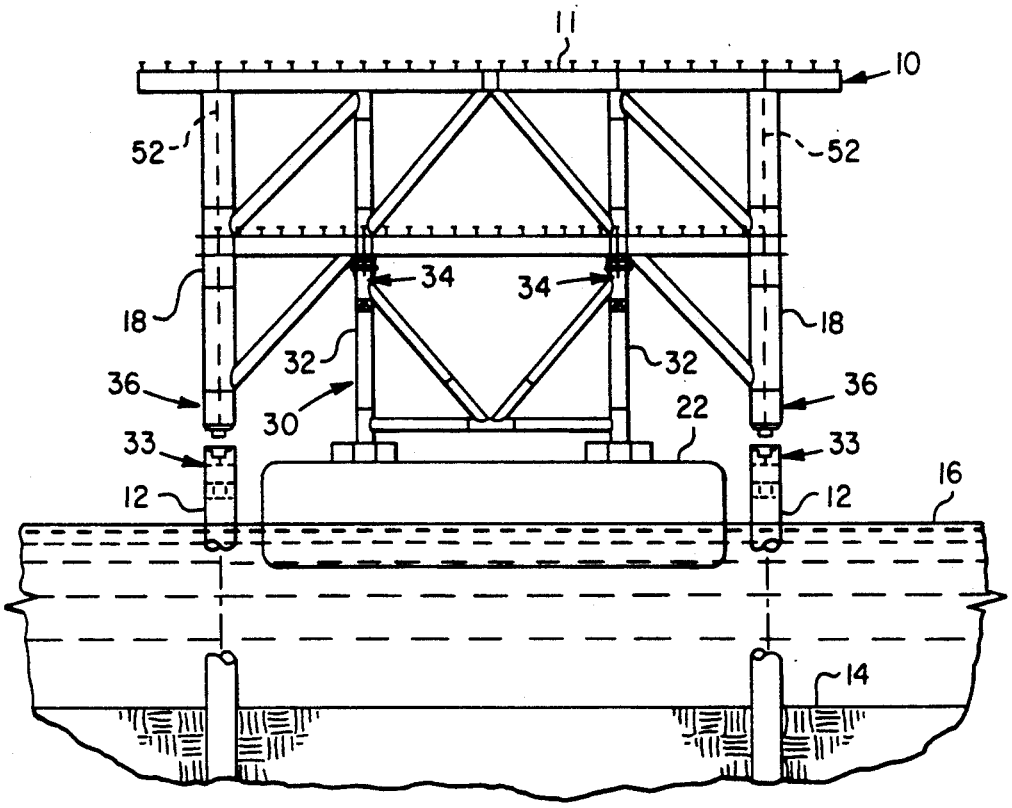
FIG. 1 is a side elevation showing a bargesupported deck or platform in position to be transferred to plural support piles.

In the description which follows, like parts are marked throughout the specification and drawing with the same reference numerals, respectively. The drawing figures are not necessarily to scale in the interest of clarity and conciseness.

Figure 2:
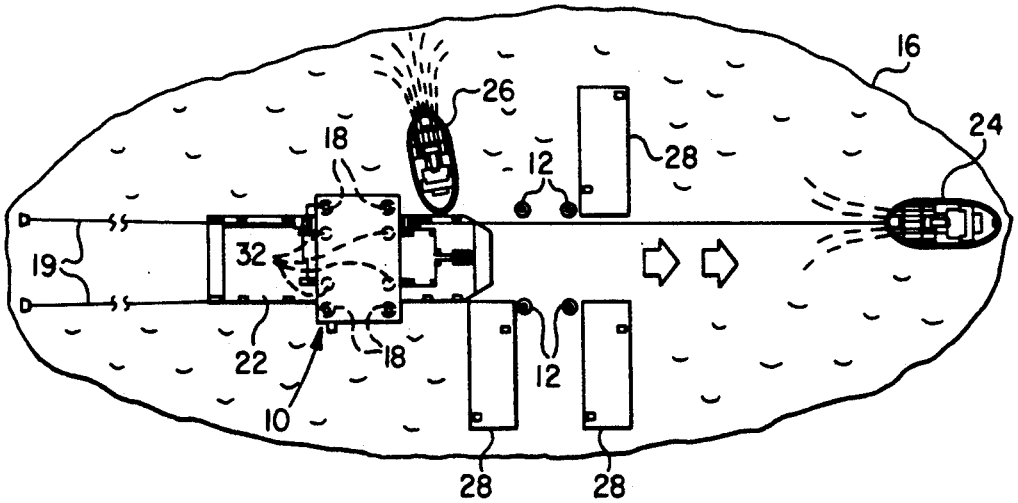
FIG. 2 is a plan view showing the bargemounted deck being moved into its final position for being mated with the support piles.

Referring to FIGS. 1 and 2 there is illustrated an integrated deck module or offshore platform 10 being positioned above a marine substructure which may comprise a fixed or floating jacket, not shown, or four independent upstanding columns or piles 12. In the exemplary illustration, the columns 12 are comprised of piles which have been driven into the seabed 14 in a relatively shallow, normally calm sea 16. The present invention may be practiced in deeper, less calm seas. The deck or platform 10 is of generally conventional construction and is fitted with four depending legs 18 which are spaced apart in a rectangular pattern corresponding to the pattern of the columns 12.

FIGS. 1 and 2 illustrate the deck 10 being moved into position over the columns 12 by a floating vessel 22 comprising a barge which is capable of being ballasted down so that the deck may be moved vertically downward, once it is in proper position, into supported engagement with the columns 12. FIG. 2 illustrates a preferred method of moving the deck 10 into position with the barge 22 including an arrangement wherein a tugboat 24 tows the barge 22 into its final position while being guided by a second tugboat 26. Spud barges 28 are positioned adjacent to the columns 12 as a protective measure.

The deck 10 is supported on the barge 22 by a support assembly, generally designated by the numeral 30, and characterized by four generally upstanding, spaced-apart deck support columns 32. Each of the support columns 32 is provided with suitable one way jack means, generally designated by the numeral 34, provided at the upper ends of the columns and which will be explained in further detail hereinbelow. In like manner, each of the depending legs 18 of the deck 10 is provided with a shock-absorbing, stabbing tip assembly 36 and each of the columns 12 is provided with a stabbing tip receiver shoe and one way jack assembly 33, both of which will also be explained in further detail hereinbelow.

Figure 3:
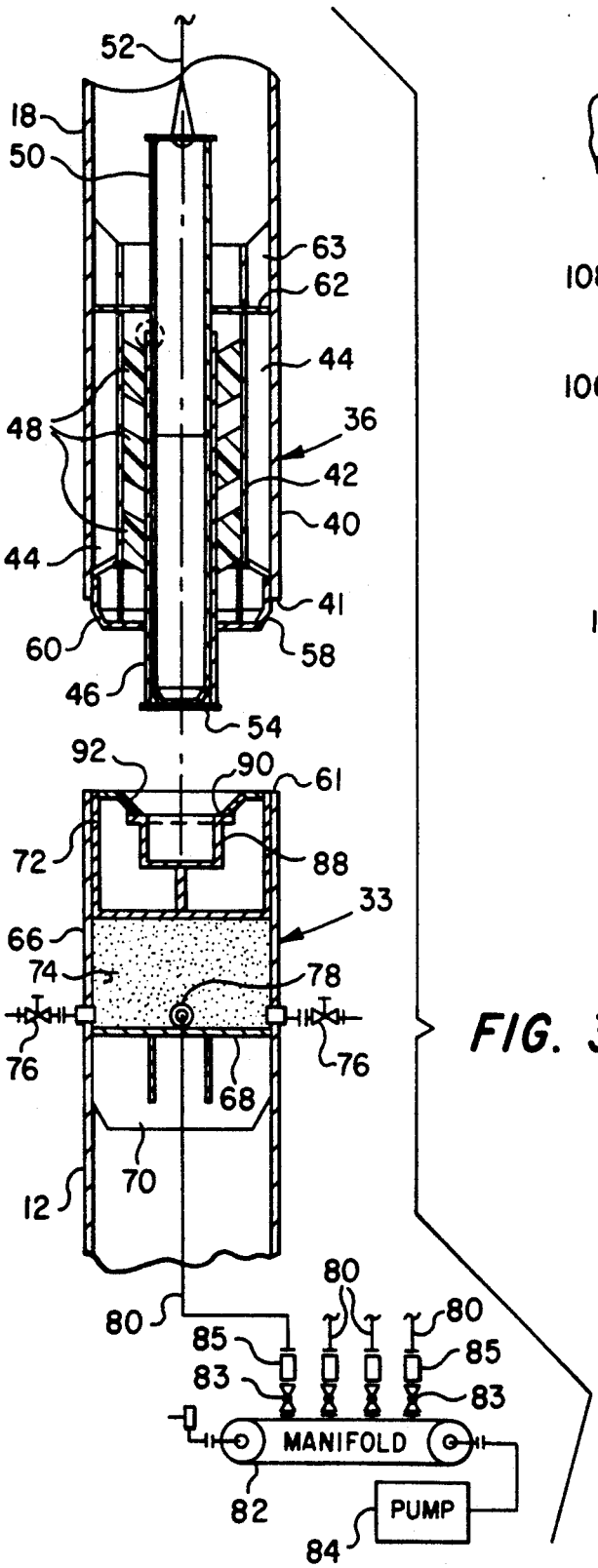
FIG. 3 is a central longitudinal section view through one of the stabbing tip assemblies and one of the sand jack assemblies disposed on top of a support pile.

Referring now to FIG. 3, there is illustrated one each of a stabbing tip assembly 36 and a jack assembly 33 disposed on one of the depending legs 18 and on one of the support columns 12, respectively. Each of the stabbing tip assemblies 36 is provided with a generally cylindrical outer body member 40 which is suitably welded to the lower end of the one of the legs 18 to form a depending extension thereof. The outer body member 40 is adapted to support coaxially with respect thereto cylindrical outer sleeve member 42 by plural radially-projecting gussets 44. The sleeve member 42 is adapted to support an inner sleeve member 46 which also comprises a generally cylindrical tube extending generally coaxially with respect to the body member 40 and the sleeve member 42. The sleeve members 42 and 46 are interconnected by plural spaced-apart annular elastomeric shock-absorbing members 48 which are suitably bonded on their outer and inner peripheral surfaces to the members 42 and 46, respectively.

The inner sleeve 46 journals an elongated, cylindrical stabbing or locating pin 50 which is shown in FIG. 3 retracted within the sleeve 46 and suspended within the sleeve 46 by a releasable cable 52. The cable 52 extends upward through the deck leg 18 to a suitable termination, not shown, at the top level 11, FIG. 1, of the deck 10, for example, so that it may be accessed to be released at will. A temporary cover 54, FIG. 3, may be welded in place across the lower distal end of the sleeve 46 to also prevent the pin 50 from deploying downwardly. A fabricated head assembly 58 is disposed over the lower end of the outer body 40 and is provided with a frustoconical guide surface 60 for guiding the stabbing pin assembly 36 and its associated leg 18 into the upper end of a column 12 as defined by the jack assembly 33. Thanks to the arrangement of the sleeve 46, the resilient collars 48 and the outer sleeve 42, the stabbing pin assembly 36 serves to locate the leg 18 with respect to the column 12, as will be further explained, and to absorb generally vertical as well as lateral shock loads occurring between the leg 18 and the column 12 during the mating procedure. In this way, movement of the deck 10 and the barge 22 during the mating procedure minimizes the chance of damage to either the column 12 or the leg 18. In a preferred arrangement the shock absorbing assembly comprising the sleeve 42, the elastomeric collars 48 and the sleeve 46 is held captive within the body 40 by the head 58 and a transverse ring plate member 62. In this way, the sleeve 42 is not required to be welded to the gussets 44 which project radially inwardly and journal the sleeve 42 in a coaxial position relative to the leg 18. Forces are transferred from the collars 48 to the sleeve 42 and to the leg 18 through the plate 62 and suitable gussets 63.

Referring further to FIG. 3, the jack assembly 33 includes a generally cylindrical, outer body member 66 having a transverse lower diaphragm or closure plate 68 secured thereto, together with downwardly-projecting web members 70 which serve to locate the body 66 on top of the column 12 prior to welding the body 66 to the column at contiguous surfaces. A generally cylindrical receiver shoe 72 is adapted to be slidably disposed in the body 66 and supported in a predetermined position therein by the provision of flowable particulate material, such as relatively fine sand 74. The material 74 may be discharged from the interior of the body 66 through suitable discharge valves 76. Removal of the sand 74 from the interior of the body 66 is advantageously aided by introduction of washing water through a port 78 by way of a supply conduit 80 which is connected to a manifold 82 and a supply pump 84. Flow control valves 83 and flowmeters 85 are interposed in each of the conduits 80. Since each of the columns 12 is provided with a jack assembly 33 and each of the legs 18 is provided with a stabbing pin assembly 36, the manifold 82 is also connected to additional sand wash water supply conduits 80 leading to each of the jack assemblies 33.

Each of the receiver shoes 72 is characterized by a generally cylindrical receptacle portion 88 delimited at its upper end by a transverse shoulder 90 which in turn is delimited by a guide funnel portion 92. The receptacle 88 is dimensioned to receive the pin 50 when it is released by the cable 52 to drop through the sleeve 46 to provide a locating member to minimize lateral excursion of the deck 10 with respect to the columns 12 during the mating procedure. However, any tendency for the deck 10 to move laterally with respect to the column 12 may be accommodated slightly by lateral deflection of the collars 48. As the deck legs 18 are lowered into position to engage the columns 12, the sleeves 46 also engage the transverse shoulders 90 so that vertical loading between the legs 18 and the columns 12 may begin. As this loading progresses the collars 48 deflect axially upwardly, viewing FIG. 3, as the outer body 40 moves downwardly into engagement with the upper end of the body 66. This procedure will eventually take place as the jack 33 is operated to allow the receiver shoe 72 to drop vertically within the body 66 upon removal of the sand 74 therefrom until the head 58 guides the body 40 into its final position so that the edges 41 and 61 become contiguous. At this point the entire weight of the deck 10 is transferred to the columns 12 by way of the legs 18, the outer bodies 40 of the stabbing tip assemblies 36 and the outer body 66 of the jack 33.

Figure 4:
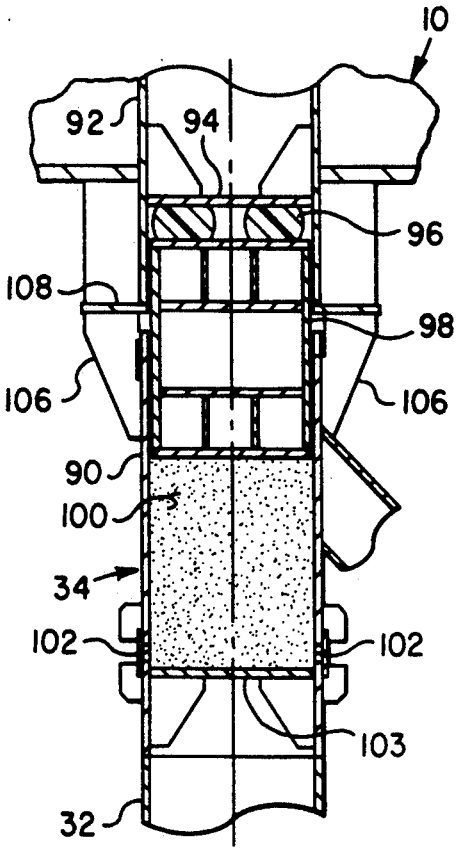
FIG. 4 is a vertical central section view of a barge-to-deck support and sand jack assembly.

Referring now to FIG. 4, each of the barge support columns 32 is provided at its upper end with one of the jack assemblies 34 which is characterized by a generally cylindrical outer body 90 coaxially aligned with a depending support column member 92 comprising part of the deck 10. Each column member 92 has a transverse support plate 94 for a generally annular resilient shock pad 96. The shock pad 96 is interposed between the plate 94 and a generally cylindrical closed ends can member 98 slidably disposed within the body 90 and supported on a quantity of flowable particulate material, such as sand 100. The sand 100 may be removed from the interior of the body 90 by removal of plural covers 102 which are disposed over ports formed in the body 90 adjacent to a lower transverse support plate or diaphragm member 103. Each of the jack assemblies 34 is secured to the deck 10 by a plurality of circumferentially-spaced gussets 106 which are secured to the body 90 and are temporarily welded to a transverse flange 108. When the deck 10 is set down on the support column assembly 30 and the shock-absorbing members 96 are suitably compressed, the gussets 106 are then welded to the flange 108 and to the outer surface of the body 90.

Figure 5:
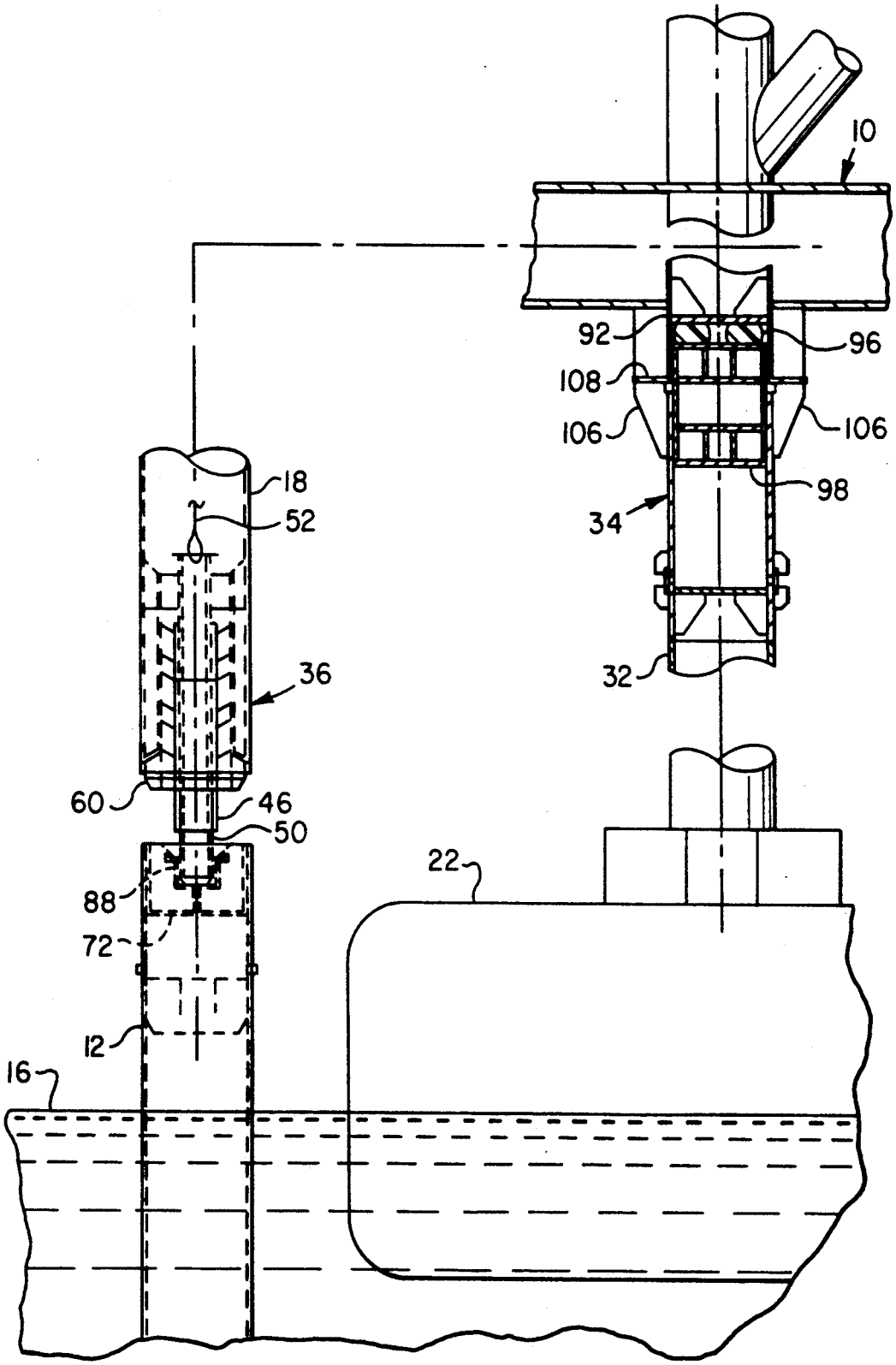
FIGS. 5 through 9 are somewhat diagrammatic views showing certain ones of the steps in the transfer method of the present invention.
Figure 6:
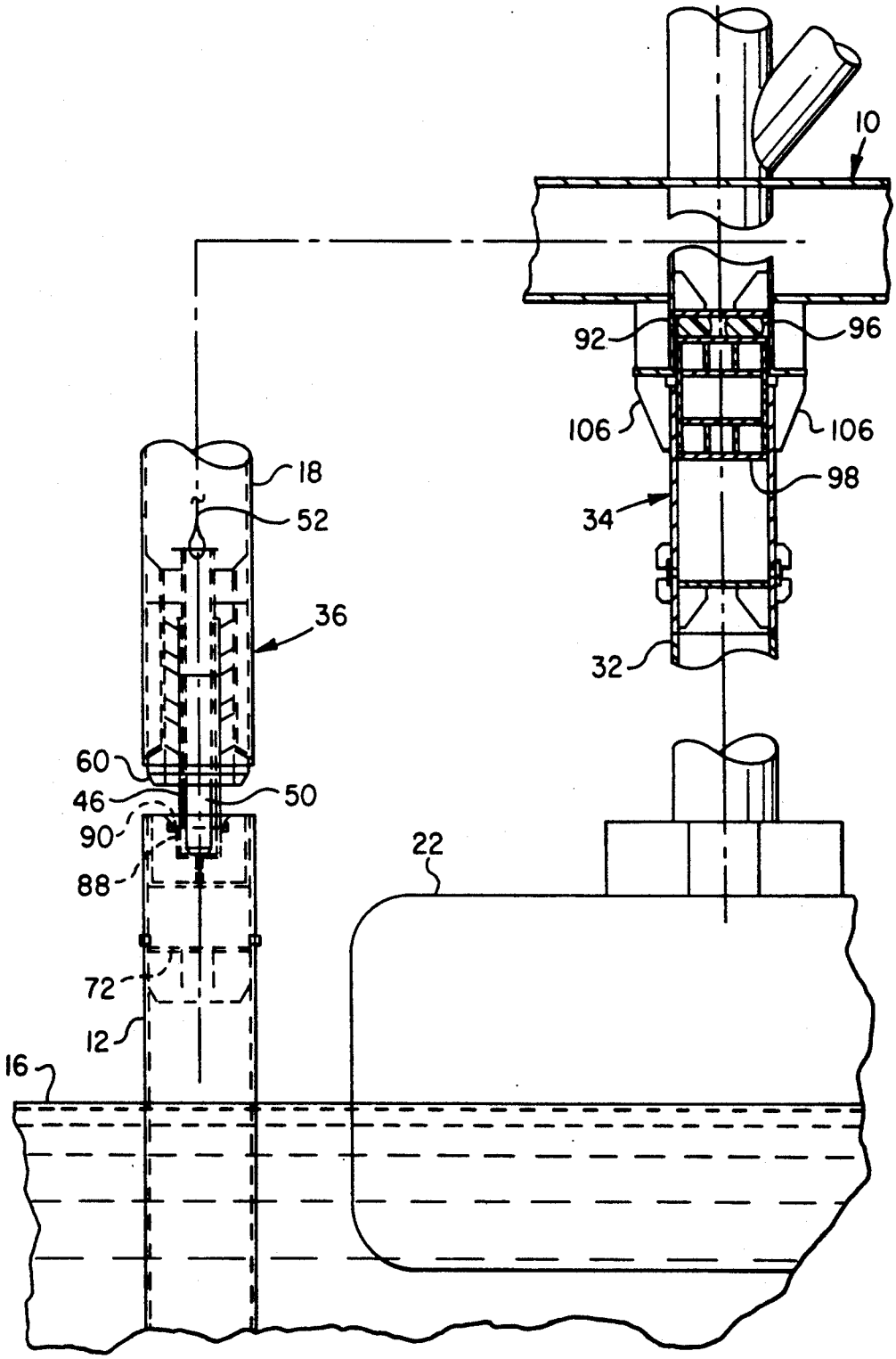

Once the barge 22 has been moved into position so that the legs 18 are aligned with the columns 12 as much as possible by maneuvering with the tug boats 24 and 26 and suitable anchor lines rigged to one or more of the spud barges 28 and through suitable ground tackle 19, FIG. 2, the temporary covers 54 are removed from the lower ends of the sleeves 46 and the cables 52 are released to allow the pins 50 to drop into the receptacles 88. This condition, illustrated in FIG. 5, restricts the lateral movement of the deck 10 at the connection formed at this point by the stabbing tips 36 to the columns 12. At this time, ballasting of the barge 22 may also begin to lower the deck 10 toward the columns 12. As the barge 22 is ballasted down, the sleeves 46 of the stabbing tip assemblies 36 engage the shoulders 90 of the receiver shoes 72 and any vertical movement between the deck 10 and the columns 12 may then be accommodated to some extent by axial deflection of the collars 48. In like manner, any tendency for lateral movement of the deck 10 with respect to the columns 12 may also be, to a limited extent, accommodated by the resilient elastomeric collars 48 without damage to the legs 18 or the columns 12. The operating condition just described is also illustrated in FIG. 6 showing engagement of the sleeves 46 with the shoulders 90 on the receiver shoes 12.

Figure 7:
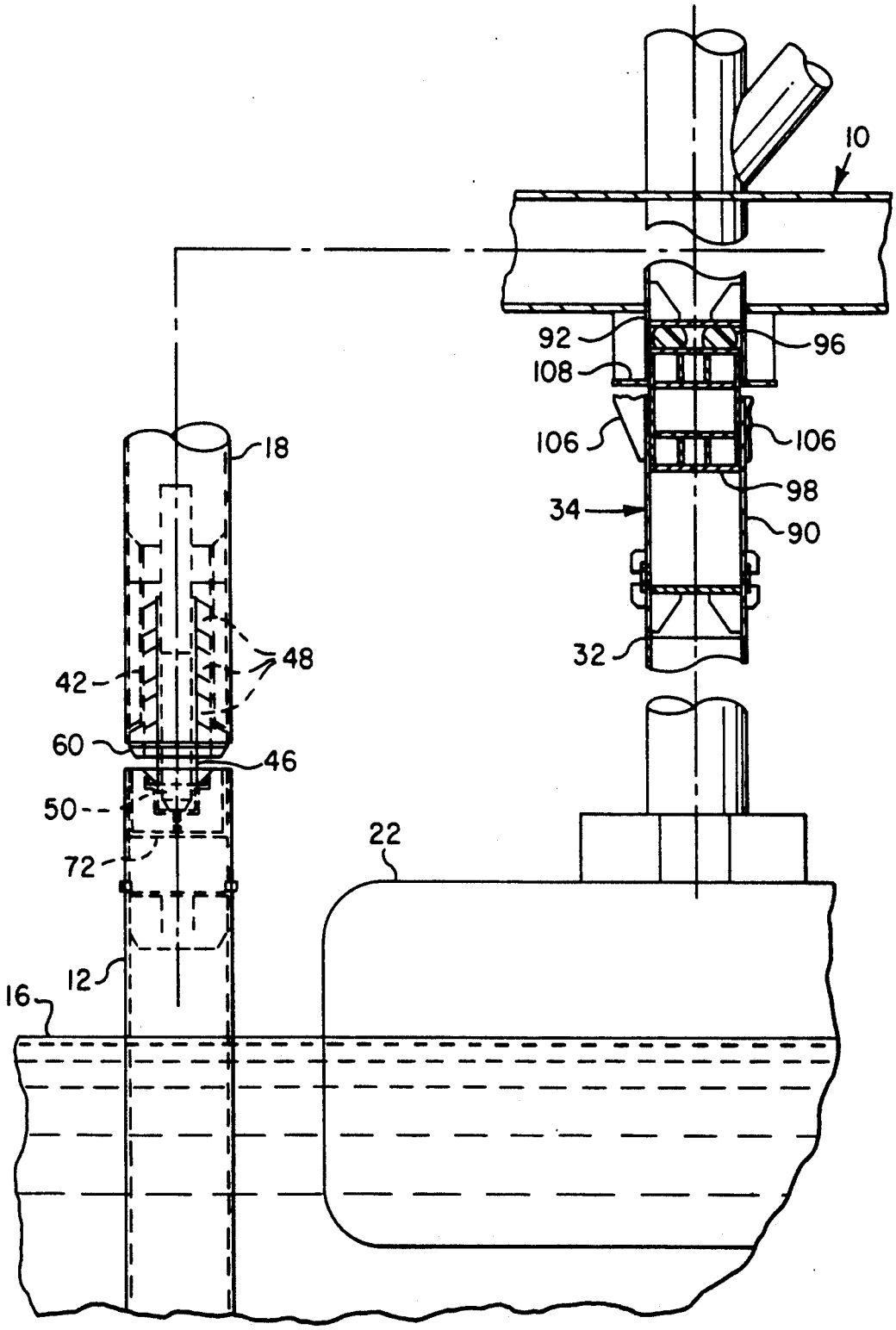

FIG. 7 illustrates the change in condition of the stabbing tip assemblies 36, by way of example, as ballasting of the barge 22 continues until the weight of the deck 10 is completely transferred to and through the stabbing tip assemblies 36 by way of the collars 48 which have become deflected somewhat vertically upwardly from the previous relaxed downward projected condition. In order to monitor and equalize the loads on each stabbing tip assembly 36 the sleeves 46 are preferably fitted with suitable strain gages and associated readout instrumentation, not shown. FIG. 7 also illustrates that one or more of the gussets 106 have been separated from the flange 108 in preparation for final separation from the deck 10.

Figure 8:
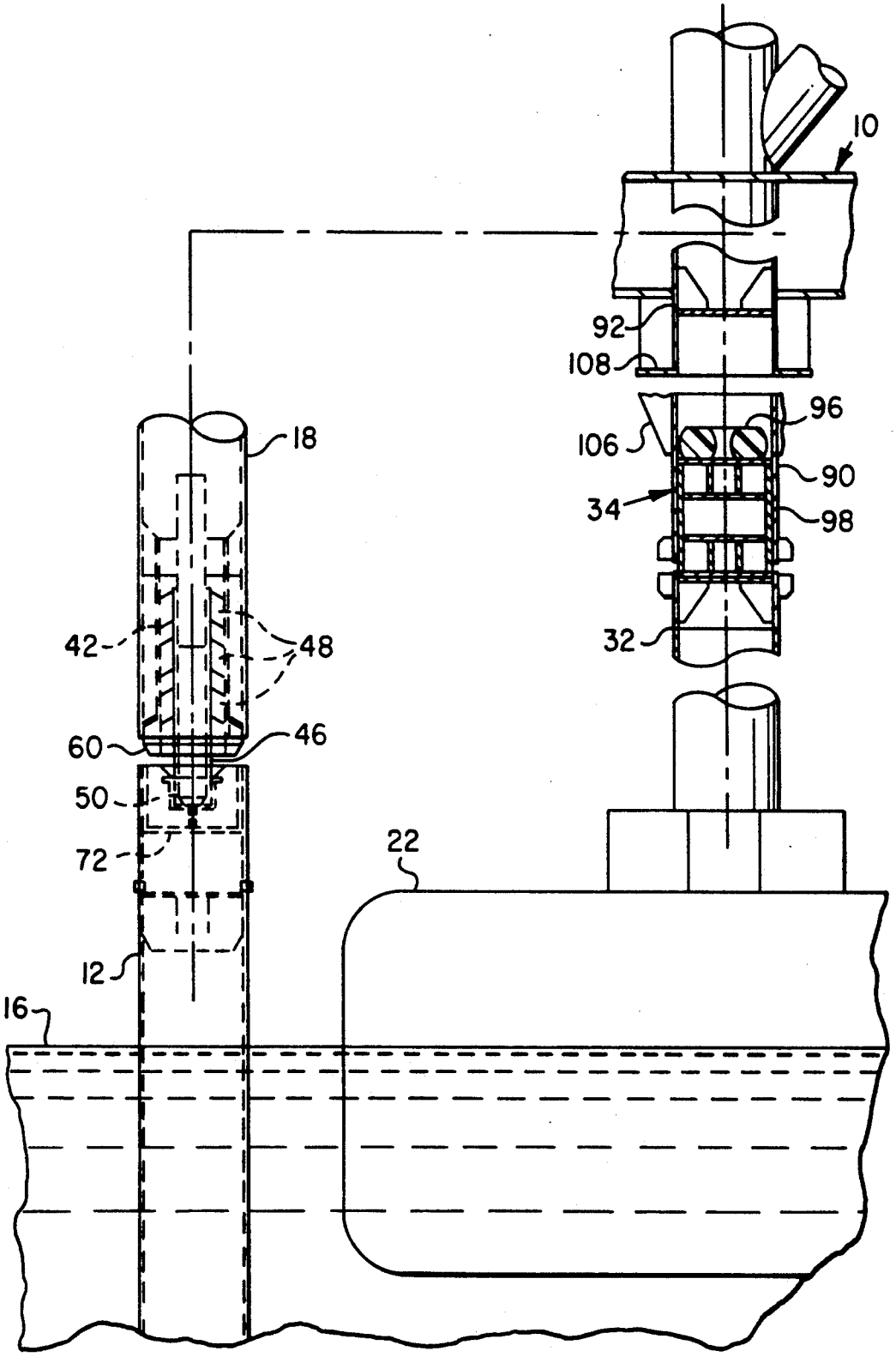
Figure 9:
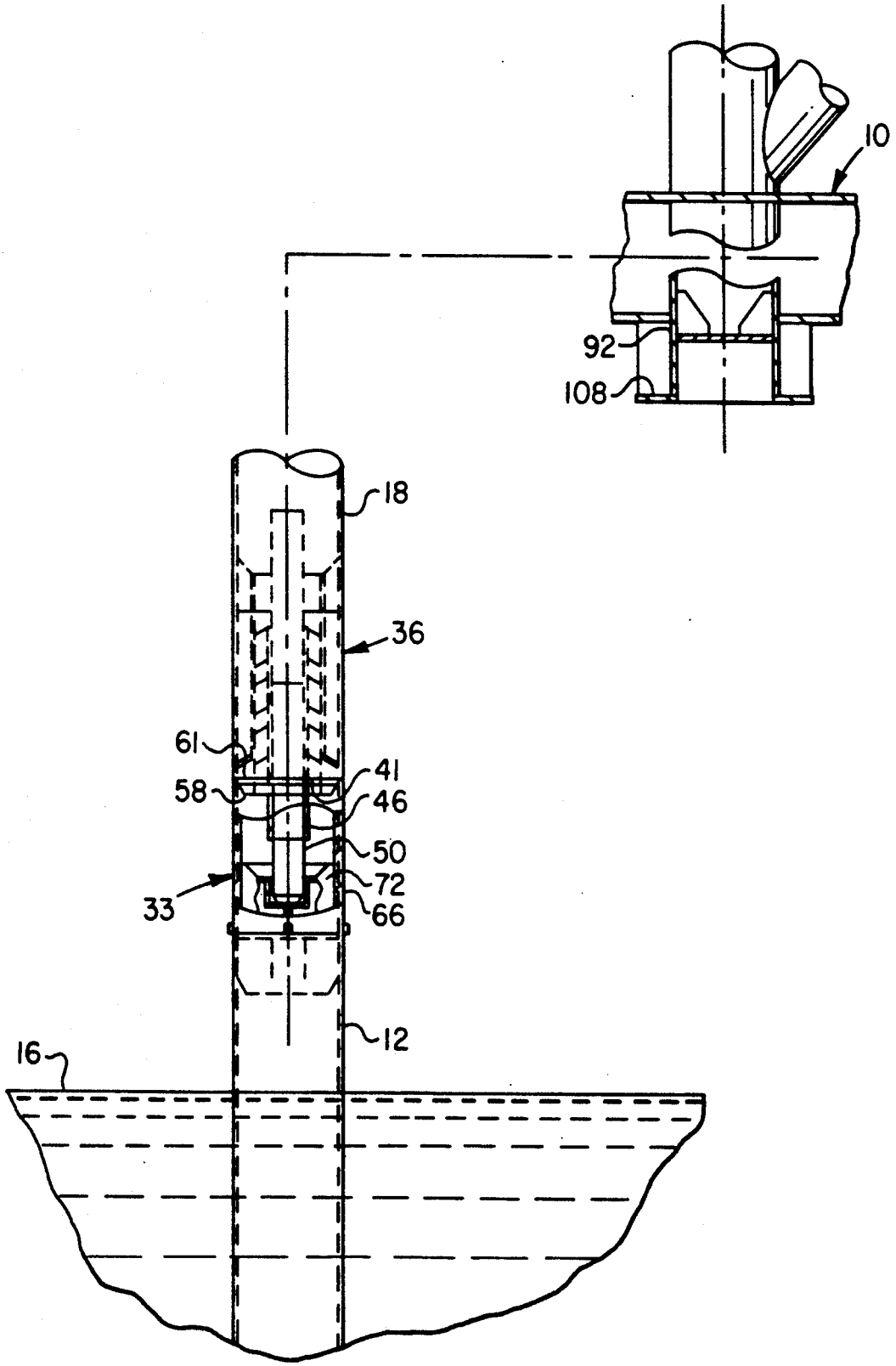

Referring also now to FIG. 8, prior to complete transfer of all of the weight of the deck 10 to the columns 12 through the collars 48, all of the gussets 106 are cut to release the connection between the jacks 34 and the deck columns 92. At this time, the ports 102 may be uncovered to release sand 100 from the jacks 34 to allow the bodies 96 and support cans 98 to drop down entirely within the bodies 90, thereby making it possible for moving the barge 22 and its support column assembly 30 out from under the deck 10. Alternatively, once the gussets 106 have been cut, it may be possible to continue ballasting the barge down sufficiently to allow the tops of the cans 98 to clear the bottoms of the columns 92 without releasing sand 100.

Once the barge 22 has been removed from under the in-place deck 10, the procedure is carried out for final lowering of the deck to result in steel-on-steel contact between the deck legs 18 and the columns 12, via the jack assemblies 33. The procedure for final lowering of the legs into steel-on-steel contact with the columns is accomplished by lowering the one way jacks 33. Each of the four deck legs 18 is closely monitored during this procedure to maintain approximately level trim of the deck 10. After the conduits 80 are connected to each of the jack bodies 66, the valves 76 are opened and the pump 84 is started to pump water into the quantity of sand 74 in each of the bodies. The individual control valves 83 and flow meters 85 are adjusted for each of the flow lines 80. The valves 83 are initially set at the same flow rate to saturate the sand 74 in each of the jacks 33 and to begin washing the sand out of the bodies 66. All four jacks 33 are lowered at the same rate by synchronizing the movement of the receiver shoes 72 and legs 18. If one leg 18 is being lowered ahead of the others, then the valves 76 on that leg and/or the water flow rate through the flow line 80 to that leg is adjusted to reduce the sand washout rate. The speed of lowering may be reduced as the legs 18 approach steel-on-steel contact with the top edges 61 of the bodies 66. Of course, once contact takes place, the washout water to the jacks 33 is turned off and the legs and piles are finally connected by butt welding or the like at the contiguous edges 61, 41.

The above-mentioned mating procedure is carried out using conventional vessels and mooring procedures. For example, surge lines and tuggers or winches, not shown, may be rigged up between the barge 22 and the columns 12 to reduce barge motion. The use of nylon surge lines should reduce surge motions of the barge 22 and dynamic loads acting on the stabbing tip assemblies 36.

The present invention may be practiced using conventional materials for the construction of the deck 10, the columns 12, and the elastomeric members 48 and 96. Natural rubber and urethane materials may be used for the members 49 and 96, respectively. Generally, other than the steps carried out herein which are believed to be novel, other steps in preparation for transfer of the deck 10 to the substructure may be carried out using conventional marine practices in the offshore petroleum industry.

Although a preferred embodiment of a system and method in accordance with the present invention have been described herein, respectively, those skilled in the art will recognize that various substitutions and modifications may be made to the specific features described without departing from the scope and spirit of the invention as recited in the appended claims.

What is claimed is:

1. In an offshore platform, in combination, a deck for installation to be supported by a substructure including a plurality of upstanding column members, said deck including a corresponding plurality of depending legs, the improvement characterized by:

at least one of said legs including a stabbing tip assembly for engagement with a corresponding column member, said stabbing tip assembly comprising an outer body for engagement with said column member to transfer permanent weight of said deck to said column member, a generally vertically moveable locating pin disposed in said body for movement to stab into receiver means including means forming a receptacle on said column member for locating said deck with respect to said column member, and resilient means supported by said body for accommodating lateral and vertically-imposed loads acting between said column member and said leg during placement of said deck on said substructure to minimize the imposition of peak forces on said deck and said substructure;

said receiver means comprising a generally cylindrical receiver shoe forming said receptacle, said shoe comprising part of a jack assembly supported on said column member and said shoe being operable to be moved to a position to permit contact of said leg with said column member to provide supporting relationship therebetween; and said jack assembly comprising a generally cylindrical body member supported on said column member and forming a chamber with said shoe for receiving particulate material to support said shoe in a first position for receiving said locating pin, said shoe being moveable to a second position in response to removing said particulate material from said chamber to permit movement of said leg into engagement with said body member.

2. The invention set forth in claim 1 including:

means for conducting liquid to said chamber to wash said particulate material therefrom.

3. The invention set forth in claim 2 wherein:

said means for conducting liquid includes a pump and means for controlling the flow rate of liquid to said chamber to control the rate of removal of said material therefrom.

4. For use in the installation of a deck on a marine substructure wherein said deck is transported into position for transfer to said substructure by a floating vessel, the improvement characterized by:

said vessel including deck support means comprising a plurality of jack assemblies for supporting said deck with respect to said vessel, said jack assemblies each including a generally cylindrical body forming a chamber for receiving particulate material, a jack member supported on said particulate material within said body and engageable with corresponding jack-receiving means on said deck, resilient support means interposed between said jack member and said deck for cushioning forces interacting between said vessel and said deck, and means for removing said particulate material from said chamber to disengage said jack member from said jack-receiving means.

5. The invention set forth in claim 4 including:

rigid support means interconnecting said deck and said deck support means, said rigid support means being disengageable to permit said jack member to disengage from said jack receiving means on said deck.

6. A method for transferring a deck comprising a plurality of depending legs to a marine substructure characterized by a corresponding plurality of upstanding column members, comprising the steps of:

providing each of said legs with a stabbing tip assembly including a locating pin for engagement with corresponding receiver means on said column members, respectively, and resilient shock absorbing means to permit at least vertical shock-absorbed movement of said legs during transfer of said deck to said substructure;

supporting said deck by a floating vessel with respect to said substructure;

providing jack means interconnecting said vessel with said deck;

positioning said vessel with respect to said substructure so that said legs are substantially coaxial with said column members;

inserting said pins into receptacle means to maintain the location of said deck relative to said substructure;

lowering said deck into initial engagement of said shock-absorbing means with said substructure;

disconnecting said vessel from said deck by actuating said jack means to disengage support means on said vessel from said deck; and further lowering said deck to engage said legs with said column members for support of said deck by said column members.

7. The method set forth in claim 6 wherein:

the step of lowering said deck to engage said shock absorbing means includes the step of ballasting down said vessel.

8. The method set forth in claim 6, including the step of:

providing said substructure with jack means on said column members for receiving said legs of said deck, and the step of lowering said deck into engagement of said legs with said column members includes activating said jack means to lower said stabbing tip assemblies into engagement with said column members.

9. The method set forth in claim 8 wherein;

said jack means include a quantity of particulate material flowable away from said jack means to provide for lowering said stabbing tip assemblies into engagement with said column members and said method includes the step of;

conducting a quantity of liquid to each of said jack means to remove particulate material therefrom to effect lowering of each of said jack means to provide for engagement of said stabbing tip assemblies with said column members.

10. In a deck for installation offshore to be supported by a substructure including a plurality of upstanding column members, said deck including a corresponding plurality of depending legs, the improvement characterized by:

at least one of said legs including a stabbing tip assembly for engagement with a corresponding column member, said stabbing tip assembly comprising an outer body for engagement with said column member to transfer permanent weight of said deck to said column member, a first sleeve and a second sleeve, said second sleeve being engageable with means on said column member for transferring vertically-imposed loads including at least part of the weight of said deck to said column member, a generally vertically moveable locating pin disposed in said body for movement to stab into a receiver receptacle on said column member for locating said deck with respect to said column member, and resilient means supported by said body and comprising elastomeric collar means interposed between said first sleeve and said second sleeve for accommodating lateral and vertically-imposed loads acting between said column member and said leg during placement of said deck on said substructure to minimize the imposition of peak forces on said deck and said substructure.

11. The invention set forth in claim 10 wherein:

said locating pin is disposed in said second sleeve in telescoping relationship thereto.

12. The invention set forth in claim 10 wherein:

said elastomeric collar means is secured to said first and second sleeves and is operable to permit displacement of said second sleeve with respect to said first sleeve while absorbing shock forces exerted between said leg and said collar member during placement of said deck on said substructure.

13. In combination, a deck for installation offshore to be supported by a substructure including a plurality of upstanding column members, said deck including a corresponding plurality of depending legs and being transportable into position for transfer to said substructure by floating vessel means, the improvement characterized by:

at least one of said legs including a stabbing tip assembly for engagement with a corresponding column member, said stabbing tip assembly comprising an outer body for engagement with said column member to transfer permanent weight of said deck to said column member, a generally vertically moveable locating pin disposed in said body for movement to stab into a receiver receptacle on said column member for locating said deck with respect to said column member, and resilient means supported by said body for accommodating lateral and vertically-imposed loads acting between said column member and said leg during placement of said deck on said substructure to minimize the imposition of peak forces on said deck and said substructure; and said vessel means including deck support means comprising a plurality of jack assemblies for supporting said deck with respect to said vessel, said jack assemblies each including a generally cylindrical body forming a chamber for receiving particulate material, and a jack member supported on said particulate material within said body for registration with corresponding jack-receiving means on said deck.

14. The invention set forth in claim 13 including:

resilient support means interposed between said jack member and said deck for cushioning forces interacting between said vessel and said deck.

15. The invention set forth in claim 13 including:

rigid support means interconnecting said deck and said deck support means, sad rigid support means being disengageable to perit said jack member to disengage from said jack receiving means on said deck.

* * * * *